United States Patent [19]

Smeda et al.

[11] 4,013,294

[45] Mar. 22, 1977

[54] PERSONALITY NEED HIERARCHY GAME

[75] Inventors: Ralph Smeda, Reston, Va.; Martha S. Swartz, Rochester, N.Y.

[73] Assignee: The Singer Company, New York, N.Y.

[22] Filed: May 4, 1976

[21] Appl. No.: 683,141

Related U.S. Application Data

[63] Continuation of Ser. No. 535,269, Dec. 23, 1974, abandoned.

[52] U.S. Cl. ..... 273/134 B; 273/134 AD; 273/134 AT; 273/134 D

[51] Int. Cl.[2] ..... A63F 3/00

[58] Field of Search ..... 273/134

[56] References Cited

UNITED STATES PATENTS

| | | | |
|---|---|---|---|
| 298,992 | 5/1884 | Lewis | 273/134 D |
| 447,247 | 2/1891 | Jones | 273/134 BD |

FOREIGN PATENTS OR APPLICATIONS

| | | | |
|---|---|---|---|
| 53,798 | 5/1911 | Switzerland | 273/134 D |

*Primary Examiner*—Delbert B. Lowe
*Attorney, Agent, or Firm*—Edward L. Bell; Charles R. Lewis; Wallace G. Walter

[57] ABSTRACT

A point competitive board game played by a plurality of players for amusement and to create an awareness in each player of the hierarchy of human personality needs. Each player assumes the identity of a composite personality requiring a predetermined quantity of personality need symbols made up of various amounts of survival, security, belongingness, ego-status, and self actualization. A random number selector is used to move an indicia along an ascending path of the game board through survival, security, belongingness, ego-status, and self actualization levels to accrue the required quantities of each type of personality need symbol.

7 Claims, 4 Drawing Figures

PERSONALITY NEED HIERARCHY GAME

This is a continuation of application Ser. No. 535,269, filed Dec. 23, 1974, and now abandoned.

BACKGROUND OF THE INVENTION

1. Field of the Invention.

The present invention relates to a point competitive board game played by a plurality of players for amusement and to create an awareness in each player of the hierarchy of human personality needs.

2. Prior Art.

In the field of education, there are both apparatus and methodologies by which subject matter may be learned. Once such method is incidental learning through gaming. Incidental learning is the unobtrusive learning of subject matter while one is principally engaged in an activity other than learning. One example of incidental learning is the playing of a point competitive game wherein words are formed with lettered blocks. While the overt purpose of this game is to win by accumulating the most points, one unobtrusive result is the learning of word forming skills. The playing of a game necessitates player involvement which has a greater learning impact on the participant than the traditional "read about" technique.

One area in which incidental learning through gaming is advantageous is the teaching of the hierarchy of human personality needs. This invention assumes that there are five levels of human personality needs ranging from a lowest level to a highest level. The lowest level of human personality needs is the survival level reflecting an individual's need to survive and concern with the acquisition of food, clothing, and shelter. The security level is the second level reflecting an individual's concern to feel safe, secure, and free from danger. The belongingness level is the third level reflecting an individual's concern to feel loved and befriended. The ego-status level is the fourth level reflecting an individual's concern for recognition and prestige.

The fifth and highest level of human personality needs is the self actualization level; reflecting an individual's concern for personal growth, fulfillment and meaningfulness in his life. A person cannot function at a level in the hierarchy unless his lower level needs are fulfilled. By way of example, a person cannot function in a creative self directed manner if he is sick, hungry and cold.

SUMMARY OF THE INVENTION

The present invention is a point competitive "win" game played by a plurality of players which creates an awareness in each player of the hierarchy of human personality needs and the principle that a person cannot function at a level in the hierarchy unless his lower level needs are fulfilled. The game includes a game board, at least one player moveable indicia, a random number selector, and at least one composite personality having a personality need symbol requirement assumed by each player.

The game board has a plain figure outline such as an isosceles triangle printed thereon including a lower base and an upper top and is divided into a hierarchy of survival, security, belongingness, ego-status, and self actualization levels. A continuous segmented path starting at the survival level at the base ascends through the hierarchy of levels to the self actualization level at the top. Each segment of the path contains printed matter relating to the accumulationn of personality need symbols for the level in which the segment is located. Each composite personality has a predetermined personality need symbol requirement to win and is composed of various quantities of survival, security, belongingness, ego-status and self actualization personality need symbols.

Each player adopts a composite personality and advances his indicia the number of segments dictated by the random number selector and gains or loses personality need symbols as directed by the printed matter in the segment utilized. A player recirculates along the path at one level until he accumulates the personality need symbols required by his composite personality and then ascends to the next higher level. The first player to accumulate all the personality need symbols required by his composite personality wins the game.

In the process of playing the game, the players gain an awareness of the hierarchy of human personality needs and the principle that a person can function at a need level only if his lower level needs are fulfilled.

BRIEF DESCRIPTION OF THE DRAWINGS

The present invention will be fully understood from consideration of the following detailed description taken in conjunction with the accompanying drawings in which like reference characters refer to like parts in the several views, and wherein.

DESCRIPTION OF THE PREFERRED EMBODIMENT

Figure 2:
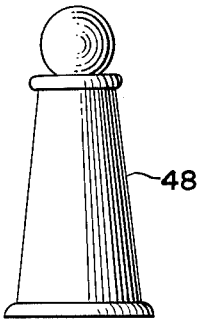
FIG. 2 is a front view of a pawn which may be utilized by each player as an indicia.
Figure 3:
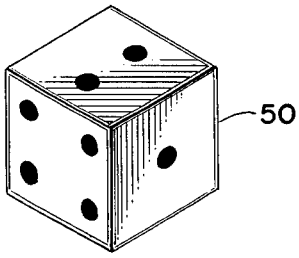
FIG. 3 is a perspective view of a die which may be utilized as a random number selector means.

As shown on the accompanying drawings, the preferred embodiment in accordance with the present invention includes a game board 10 (FIG. 1), at least one indicia per player such as pawn 48 (FIG. 2) for movement on the board 10, and a random number selector means such as die 50 (FIG. 3) to control the movement of the pawns 48, and a scoresheet 52 (FIG. 4) to record each player's score.

The game board 10 has a plain figure outline printed thereon such as an isosceles triangle 12 having a base 14 at the bottom and an apex 16 at the top. The triangle 12 is interiorly divided by four spaced apart lines 18, 20, 22, and 24 into five levels 26, 27, 28, 29, and 30. Each of the levels 26–30 is assigned one of five human personality need designations. The level 26, contiguous with the base 14, is designated as the Survival Need Level, the level 27 adjacent to the level 26 is designated as the Security Need Level, the level 28 adjacent to the level 27 is designated as the Belongingness Need Level, the level 29 adjacent to the level 28 is designated as the Ego-Status Level, and the level 30 at the apex 16 is designated as the Self Actualization Level. Survival needs reflect an individual's needs to survive and are concerned with the acquisition of food, clothing and shelter. Generally, survival means can be fulfilled through the acquisition of money. Security needs reflect an individual's concern to feel safe, secure, and free from danger. Belongingness needs reflect an individual's concern to feel loved and befriended; for example, through the establishment of friendships or group membership. Ego-Status needs reflect an individual's concern for recognition and prestige; for example, through job promotion, achievement awards or praise. Self actualization needs reflect an individual's needs for personal growth and fulfillment in his life. Each of the five personality needs is pictorially represented by a different symbol. As can best be seen in FIG. 1, the survival needs are symbolized by a dollar sign 32, the security needs are symbolized by a bond 34; the belongingness needs are symbolized by a heart 36, the ego-status needs are symbolized by a trophy cup 38, and the self actualization needs are symbolized by a star 40. It is to be understood that other signs or symbols may be equally well adapted to signify the various personality needs. The levels 26–30 may be different colors to assist each player in distinguishing between the levels 26–30.

A plurality of contiguous segments 42, each adapted to receive printed matter, forms a continuous path 44.

Figure 1:
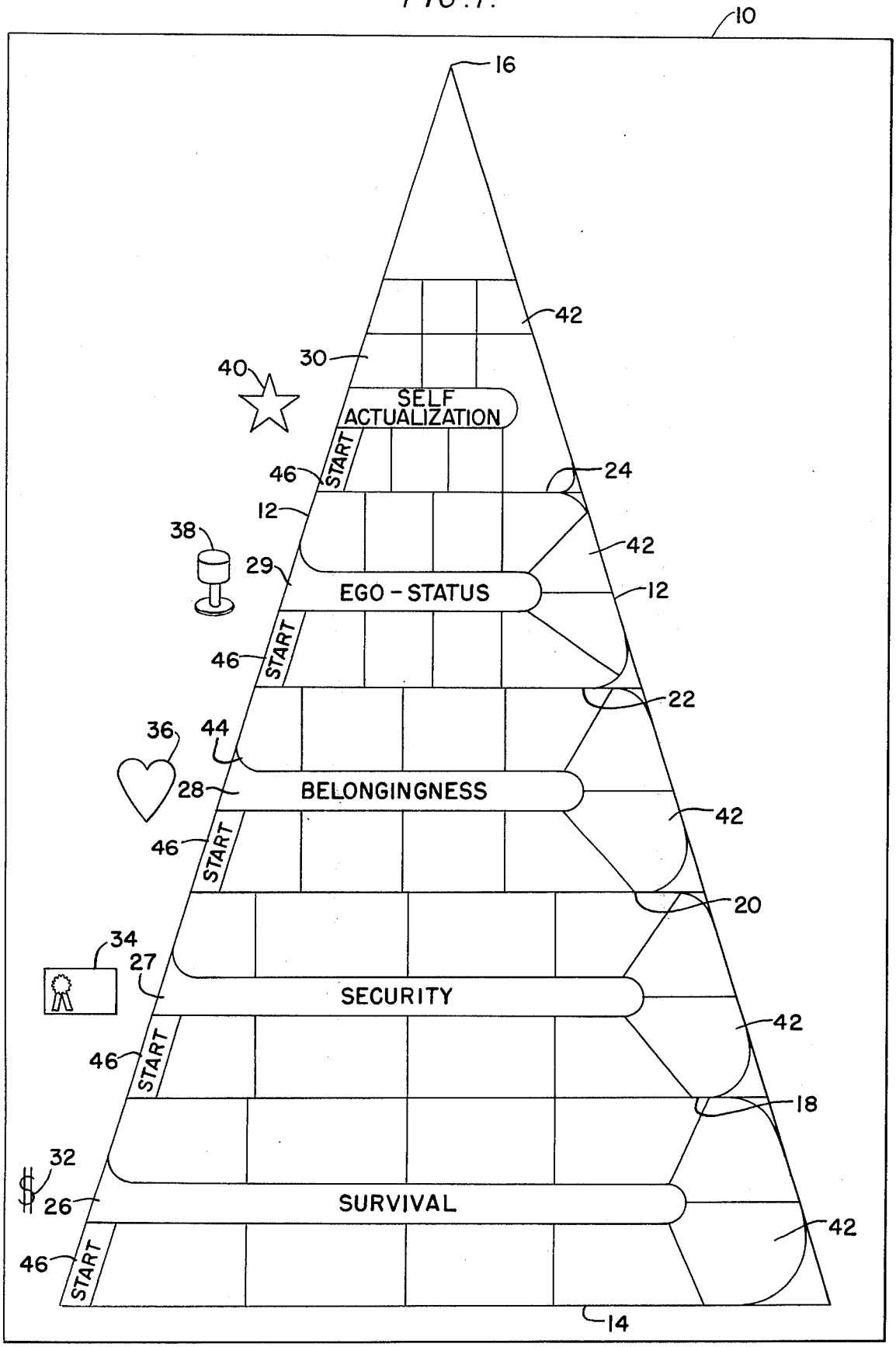
FIG. 1 is a plan view of the game board having an isosceles triangle printed thereon including a convoluted segmented path therein.

The path 44 begins at the base 14, convolutes through the levels 26–30 and ends at the apex 16. As shown in FIG. 1, each of the levels 26–30 contains ten segments 42. A start position 46 is located in the first segment 42 of each level 26–30. It is to be understood that more or fewer segments 42 may be contained within each level and the levels 26–30 do not require an equal number of segments 42. Movement of a pawn 48 along the path 44 toward the apex 16 is hereinafter referred to as ascending. Each segment 42 contains printed matter pertaining to the level 26–30 in which the segment 42 is located. The printed matter may be a declaratory statement relating to an event which may fulfill or threaten a person's personality need and a statement enumerating the number of personality need symbols associated with that statement. The number of personality need symbols associated with each declaratory statement is arbitrary. Preferably, the number of symbols associated with each statement should be such that the net number of symbols accumulated by each player after a plurality of plays [in accordance with the game rules described below] is positive, thereby enabling each player to ascend through the levels 26–30. The following fifty exemplary personality need statements and associated personality need symbol quantities may be used in the preferred embodiment. It is to be understood that other equally useful statements and associated personality need symbol quantities may be utilized.

| | |
|---|---|
| LEVEL 1 - HUMAN SURVIVAL NEEDS | |
| 1. Your doctor feels that you are in good health. | +4 Dollars |
| 2. You gave up smoking. | +3 Dollars |
| 3. Your vegetable garden is thriving. | +2 Dollars |
| 4. Your house is well insulated. | +2 Dollars |
| 5. You always wear your seat belt. | +2 Dollars |
| 6. You have just been evicted for not paying rent. | −1 Dollar |
| 7. Your blood pressure is too high. | −1 Dollar |
| 8. You were involved in a car accident. | −2 Dollars |
| 9. You are very ill. | −2 Dollars |
| 10. Your furnace broke down. | −1 Dollar |
| LEVEL 2 - SECURITY NEEDS | |
| 1. The police force does a good job. | +4 Bonds |
| 2. You had a good pension at work. | +2 Bonds |
| 3. The value of your house is going up. | +2 Bonds |
| 4. You have a burgular alarm in your house. | +1 Bond |
| 5. You have a lot of seniority at work. | +2 Bonds |
| 6. Your stocks portfolio has decreased in value. | −2 Bonds |
| 7. You had to cash in your insurance policy. | −1 Bond |
| 8. Inflation is eroding the value of your bank account. | −1 Bond |
| 9. Your employer does not have a pension plan. | −1 Bond |
| 10. You have been laid off from your job. | −2 Bonds |
| LEVEL 3 - BELONGINGNESS NEEDS | |
| 1. You are moving to a distant town. | −1 Heart |
| 2. You married a wonderful person. | +4 Hearts |
| 3. You have a close family. | +3 Hearts |
| 4. You are well liked. | +3 Hearts |
| 5. You like to work in a team. | +3 Hearts |
| 6. Your best friend moved away. | −1 Heart |
| 7. You have an argument with your spouse. | −1 Heart |
| 8. Your well liked relative passed away. | −2 Hearts |
| 9. You were betrayed by your best friend. | −1 Heart |
| 10. Your teenager ran away from home. | −1 Heart |
| LEVEL 4 - EGO STATUS NEEDS | |
| 1. People respect and look up to you. | +4 Trophy Cups |
| 2. You are recognized as an expert in your field. | +3 Trophy Cups |
| 3. You hit the winning home run. | +2 Trophy Cups |
| 4. Your boss complimented you. | +2 Trophy Cups |
| 5. You got a better job. | +4 Trophy Cups |
| 6. You were humiliated in front of your friends. | −1 Trophy Cup |
| 7. You made a bad mistake and everyone knows. | −1 Trophy Cup |
| 8. You lost the election to the school board. | −1 Trophy Cup |
| 9. No one likes your painting. | −1 Trophy Cup |
| 10. Your writing was severely criticized. | −1 Trophy Cup |
| LEVEL 5 - SELF ACTUALIZATION NEEDS | |
| 1. You are satisfied with your life. | +5 Stars |
| 2. Learned how to paint. | +4 Stars |
| 3. Learned how to play an instrument. | +4 Stars |
| 4. You invented a new device. | +4 Stars |
| 5. You have a self directed job. | +4 Stars |
| 6. You are not motivated. | −2 Stars |
| 7. You can't find a direction in life. | −2 Stars |
| 8. Your job is unsatisfying. | −1 Star |

-continued

| | |
|---|---|
| 9. You feel hemmed in by life. | −2 Stars |
| 10. You want to get away from it all. | −1 Star |

Selected ones of the survival need statements and the dollar sign 32 symbols associated therewith are printed within selected ones of the segments 42 in the Survival Need Level 26 such that each segment 42 in the Survival Need Level 26 contains a different survival need statement. In a like manner, selected ones of the security, belongingness, ego-status, and self actualization need statements and the need symbols associated therewith are printed within selected ones of the segments 42 in the respective security, belongingness, ego-status, and self actualization levels 27–30 such that each segment 42 within a level 26–30 contains a different statement relating to that level.

In playing the game, each player must assume the personality needs of a fictional composite personality. The four exemplary personalities printed hereinafter may be utilized by four players to play the game. It is to be understood that other equally suitable composite personalities may be utilized. Each composite personality requires the same predetermined quantity of personality need symbols to be fulfilled. The predetermined quantity is composed of differing amounts of survival need dollars 32, security need bonds 34, belongingness needs hearts 36, ego-status trophy cups 38, and self actualization stars 40. For example, each of the four exemplary composite personalities below require one hundred personality need symbols to be fulfilled, yet a first composite personality may require only five survival need dollars 32 and another composite personality may require twenty survival need dollars 32. There are a plurality of equally suitable methods by which the players may select a composite personality. One such method is to print a composite personality description on one side of a paper playing card, form the cards into a deck, shuffle the deck, and distribute a card to each player.

1. Aileen Borden.

Aileen Borden is 25 years old and is associate producer of a television news program. Aileen grew up in a small city of 150,000. Her parents were very concerned about providing her with whatever she needed, especially a good education. Aileen did well in her classes, particularly English and Social Studies. She spent her leisure time either reading or editing the high school newspaper. In college, Aileen majored in journalism and planned a career in the news field. Her grades were very good. In her junior year, Aileen produced a news documentary about an incident which had occurred in her home town. After graduating, Aileen accepted a position with the Public Broadcasting Company. She feels her job offers her freedom and intellectual stimulation. Right now, she is working on a news program for children and has found this assignment to be highly creative and demanding. Aileen likes the social contact she has with her co-workers at the station, and with the children on the set. Naturally, she enjoys being recognized as a creative, talented, and promising young writer and producer. Aileen requires:

1. Five survival need dollar signs 32.
2. Five security need bonds 34.
3. Twenty belongingness need hearts 36.
4. Thirty ego-status trophy cups 38.
5. Forty self actualization need stars 40.

2. Hal Redding

Hal Redding is 21 years old. He grew up in a fairly large town and attended high school there. Hal was an exceptionally good student, particularly in the sciences, and was constantly praised by his teachers and recommended for scholarships. Hal thrived on this attention. In his junior year, he submitted a science project to the Science Fair and was awarded first prize. He was invited by many local clubs, schools, and organizations to give speeches about his project. Hal looked forward to speaking in front of others and answering their questions. In his senior year, Hal was awarded a scholarship to a very well-known college on the East Coast. He felt proud of himself and liked the way the other students looked up to him. In college, Hal became very friendly with Bob Palmer, a chemistry major. They worked together on a chemistry project with two of their professors. Hal enjoyed the "team effort" and the friendships that developed from that project. When he finished college, he was offered jobs with three firms. He accepted the job that he felt was the most intellectually stimulating and allowed him the greatest freedom to pursue his field of interest and offered him job security and fringe benefits. Hal requires:

1. Ten survival need dollar signs 32.
2. Ten security need bonds 34.
3. Thirty belongingness need hearts 36.
4. Forty ego-status need trophy cups 38.
5. Ten self actualization need stars 40.

3. Ted Carter

Ted Carter is 25 years old and has been working at the Clearview Company for seven years. Ted grew up in a small coal mining village in a depressed section of the country. Ted's father, like most of the men in town, was a coal miner. He was always underpaid and often unemployed. Ted recalls bitterly the many things he wanted as a child which his family could not afford. Ted is determined not to follow in his father's footsteps. After he graduated from high school, he moved to Jamestown, a nearby city, and got a job as a stock clerk at the Clearview Company. He is a hard worker and has been promoted several times, and is now an assistant foreman. Ted is saving a certain percent of his salary each week for a house. he likes his job for several reasons. He likes being with the men on the line. He also gets to see Amy, another worker at the Clearview Company. They are planning to get married in the future. Ted finds his job stimulating and he tries to please both his workers and the management. He likes the respect the fellows he once worked with in the stockroom have for him now that he is an assistant foreman. He also feels good when the plant superintendent praises him for his work. But, most of all, Ted appreciates the security of his job.

1. Twenty-seven survival need dollar signs 32.
2. Twenty-seven security need bonds 34.
3. Twenty belongingness need hearts 36.
4. Twenty ego-status need trophy cups 38.
5. Six self actualization need stars 40.

4. JoAnn Rivers

JoAnn Rivers is 22 years old and has been doing secretarial work for two and a half years. JoAnn is an only child and grew up in a small city where her parents owned and operated a small grocery store. They worked very hard to provide her with the things she needed. When JoAnn was 17, her father had a heart attack. He was then unable to work and sold his store to a large supermarket chain. During the years that followed, the family struggled to make ends meet. JoAnn wants very much to avoid such a trying experience in her life. After high school, JoAnn put herself through secretarial school and then got her present job as a secretary to the president of a small but growing firm. She enjoys her work a great deal. There is a lot of variety in her job and she has the opportunity to learn new things. Also, many of the people at the firm have become close friends. JoAnn sees them outside of work as well as at work and likes being part of a close-knit group. JoAnn considers being elected "Secretary of the Month" a big honor. She is also praised when her boss compliments her on her good work. JoAnn requires:

1. Twenty survival need dollar signs 32.
2. Twenty security need bonds 34.
3. Thirty-five belongingness need hearts 36.
4. Fifteen ego-status trophy need cups 38.
5. Five self actualization need stars 40.

Figure 4:
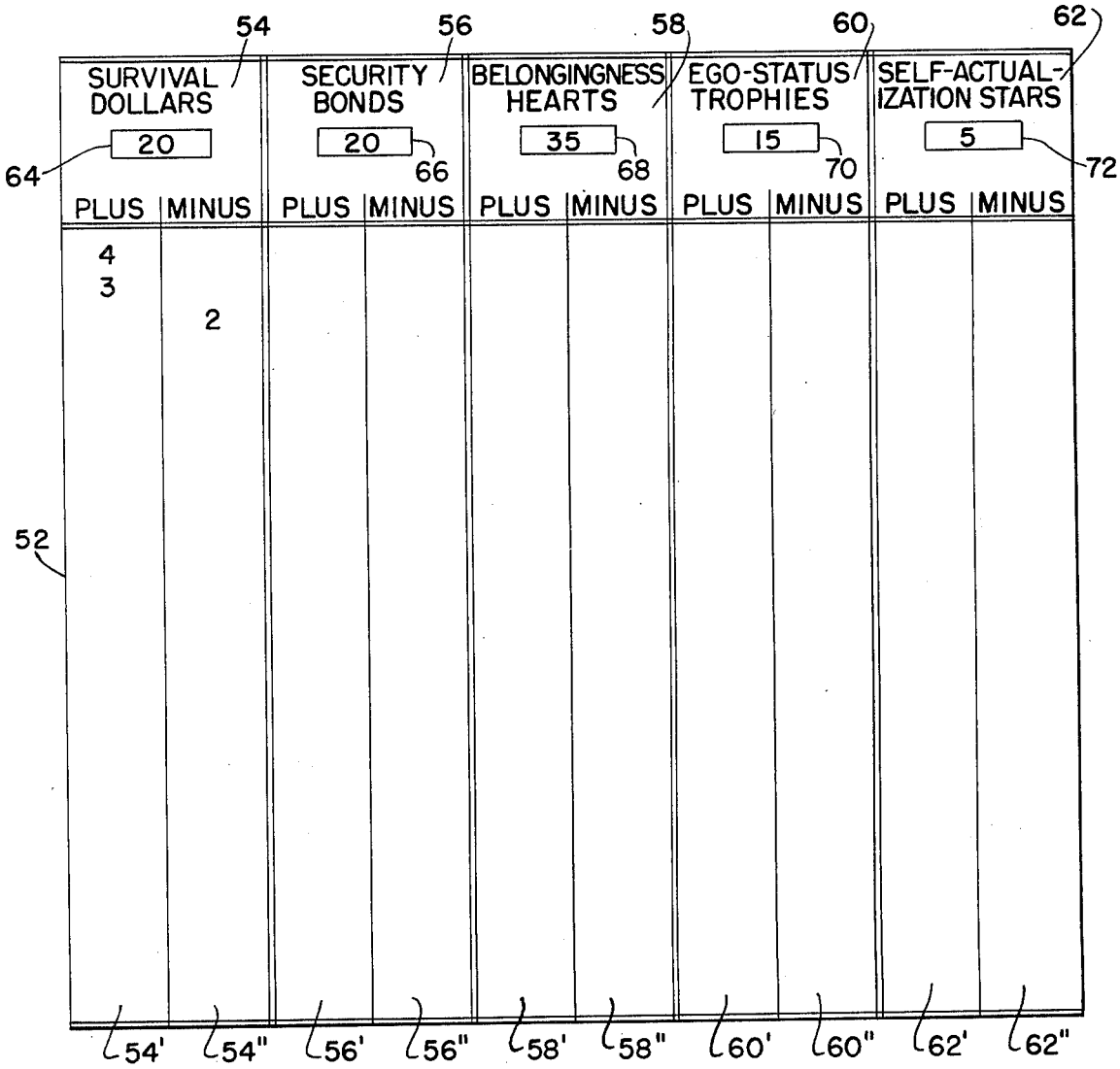
FIG. 4 is a front view of a score sheet which may be utilized with the preferred embodiment.

Each player has a score sheet 52 (FIG. 4) to record information as to the number of symbols required by his composite personality and the number of symbols gained or lost while the game is played in accordance with the rules to be described hereinafter. The score sheet 52 is divided into columns 54, 56, 58, 60 and 62. The column 54 is designated as the survival need column, has a scorebox 64 located near the top of the column 54 and is subdivided into the column 54' and the column 54''. The scorebox 64 is used to record the quantity of survival need dollars 32 required by the player's composite personality, the column 54' is used to record the number of survival need dollars 32 gained on a play, and the column 54'' is used to record the number of survival need dollars 32 lost on a play. In an analogous manner, the column 56 is designated as the security need column, has a scorebox 66 located near the top of the column 56 and is subdivided into the column 56' and the column 56'', the column 58 is designated as the belongingness need column, has a scorebox 68 located near the top of the column 58 and is subdivided into the columns 58' and 58'', the column 60 is designated as the ego-status need column, has a scorebox 70 located near the top of the column 60 and is subdivided into the columns 60' and 60'', and the column 62 is designated as the self actualization need column, has a scorebox 72 located near the top of the column 62 and is subdivided into the columns 62' and 62''. Each player records the survival, security, belongingness, ego-status, and self actualization requirements for his composite personality in the appropriate scorebox. For example, for the composite personality JoAnn Rivers printed hereinabove, the player would record, as illustrated in FIG. 4, the numeral twenty in the scorebox 64 for the survival needs dollar 32 requirement, the numeral twenty in the scorebox 66 for the security need bond requirement, the numeral thirty-five in the scorebox 68 for the belongingness heart 36 requirement, the numeral fifteen in the scorebox 70 for the ego-status trophy cup 38 requirement, and the numeral five in the scorebox 72 for the self actualization star 40 requirement.

The game is played to the following rules:

1. Each player obtains a composite personality description in accordance with the method described hereinabove and a pawn 48.
2. Each player reads his composite personality description aloud so that the other players have an idea of the needs of the different players.
3. Each player indicates on his score sheet 52 as explained above, the number of survival need dollars 32, security need bonds 34, belongingness need hearts 36, ego-status need trophys 36, and self actualization need stars 40, required by his composite personality.
4. To start the game, each player places his pawn 48 at the start position 46 of the Survival Need Level 26 and then rolls the die 50. The person throwing the highest number is the first to play.
5. The first player and each succeeding player throw the die 50, move the exact number of segments 42 on the board as the number they roll, read aloud the instructions printed on the segment 42 they land on, and gain or lose symbols as instructed by the printed matter on the segment 42. For example, if a first player on his first roll of the die 50 lands on a segment 42 instructing him to gain four survival need dollars 32, he records the numeral four in the column 54' as illustrated in FIG. 4; if on a successive roll of the die 50 he lands on a segment 42 instructing him to gain three survival need dollars 32, he records the numeral three in the column 54'; if he thereafter lands on a segment 42 instructing him to lose two survival need dollars 32, he records the numeral two in the column 54''. Each player keeps a running net total of the symbols accumulated annd as soon as a player accumulates enough symbols to equal or exceed his symbol requirement, he ascends to the start position 46 of the next higher level. For example, assume that a player has the personality need requirement illustrated on the scoresheet 52 in FIG. 4, has accumulated eighteen survival need dollars 32 toward his survival need dollar 32 requirement of twenty, and on his next roll of the die 50 lands on a segment 42 instructing him to gain four survival need dollars 32. Since the player has accumulated enough survival need dollars 32 to meet or exceed his survival need dollar 32 requirement he moves his pawn 48 to the start position 46 of the security level 27. If a player advances to the last segment 42 of a level without having accumulated enough personality need symbols, he must recirculate at the same level until he accumulates enough personality symbols. For example, assume that a player requires 20 survival need dollars 32, has accumulated eighteen survival need dollars 32, and has landed on the last segment 42 of the survival need level 26 instructing him to gain one survival need dollar 32. Since the player does not have enough survival need dollars 32 to ascend to the Security Need Level 27, he must, on the next roll of the die 50 return to the Survival Need level 26 start position 46 and continue playing at the Survival Need Level 26.

The first player to collect his required personality need symbols is declared the winner of the game.

While the overt purpose of this game is to win by being the first player to accumulate the required number of personality need symbols, each player gains an awareness of the hierarchy of human personality needs and the principle that a person cannot function at a level in the hierarchy unless his lower level needs are fulfilled.

As is apparent to those skilled in the art, various changes and modifications may be made to the personality need hierarchy game described herein without departing from the scope and spirit of the present invention.

What is claimed is:

1. An amusement and educational game for creating an awareness of human personality needs comprising:
   - a gameboard having;
   - a plane figure outline thereon interiorly divided into a plurality of levels corresponding to a hierarchy of human personality needs;
   - a plurality of continuous segments within at least some of the levels;
   - at least some of the segments at each level having intelligible matter thereon denoting a player's loss or gain of human personality needs associated with the level;
   - player moveable indicia for placing upon and traveling from segment to segment;
   - random number selector means to indicate the number of segments to be traversed by an indicia; and
   - a scoresheet for use with the game board divided into a plurality of columns corresponding to the hierarchy of human personality needs appearing on the gameboard;
   - each of the columns enabling at least one player's human personality gains or losses to be recorded thereon.

2. The amusement and educational game claimed in claim 1 in which;
   - the plane figure outline is an isosceles triangle.

3. The amusement and educational game claimed in claim 2 in which,
   - the segments form a continuous path within said triangle outline from the base to the top thereof.

4. The amusement and educational game claimed in claim 1, in which the plurality of levels includes;
   - a first level corresponding to human survival needs,
   - a second level corresponding to human security needs,
   - a third level corresponding to human belongingness needs,
   - a fourth level corresponding to human ego-status needs, and
   - a fifth level corresponding to human self actualization needs.

5. The amusement and educational game claimed in claim 4 in which,
   - said segments form a single continuous path within said figure.

6. The amusement and educational game claimed in claim 1, in which the random number selector means includes a die number selector.

7. The game recited in claim 1 wherein;
   - each of the columns is divided into a first sub-column and a second sub-column;
   - the respective first sub-columns to be used for entering human personality gains; and
   - the respective second sub-columns to be used for entering human personality losses.

* * * * *